US007432446B2

(12) United States Patent
Orfin et al.

(10) Patent No.: US 7,432,446 B2
(45) Date of Patent: Oct. 7, 2008

(54) COILED ELECTRONIC ARTICLE SURVEILLANCE (EAS) CABLE

(75) Inventors: Paul Orfin, Patchogue, NY (US); Christopher P. Klicpera, Mineola, NY (US); Michael Savona, Coram, NY (US); Timothy Kehoe, Smithtown, NY (US)

(73) Assignee: Symbol Technologies, Inc., Holtsville, NY (US)

( * ) Notice: Subject to any disclaimer, the term of this patent is extended or adjusted under 35 U.S.C. 154(b) by 0 days.

(21) Appl. No.: 11/237,577

(22) Filed: Sep. 28, 2005

(65) Prior Publication Data

US 2007/0068697 A1 Mar. 29, 2007

(51) Int. Cl.
*H01B 7/00* (2006.01)

(52) U.S. Cl. ..... 174/113 R

(58) Field of Classification Search ..... 174/113 R, 174/36

See application file for complete search history.

(56) References Cited

U.S. PATENT DOCUMENTS

| | | | | |
|---|---|---|---|---|
| 2,663,752 | A * | 12/1953 | Wier | 174/36 |
| 4,510,346 | A * | 4/1985 | Bursh et al. | 174/36 |
| 5,486,654 | A * | 1/1996 | Hanak et al. | 174/113 R |
| 6,218,621 | B1 * | 4/2001 | Kuczynski | 174/110 R |
| 6,462,268 | B1 * | 10/2002 | Hazy et al. | 174/36 |
| 6,667,098 | B1 | 12/2003 | Eklind et al. | |
| 2003/0121694 | A1 * | 7/2003 | Grogl et al. | 174/113 R |
| 2005/0029006 | A1 * | 2/2005 | Takahashi et al. | 174/102 R |

FOREIGN PATENT DOCUMENTS

| | | | |
|---|---|---|---|
| DE | 299 08 447 U1 | | 8/1999 |
| DE | 102 39 695 C1 | | 11/2003 |
| EP | 0 610 954 A1 | | 8/1994 |
| JP | 07245023 | * | 9/1995 |
| WO | WO 95/18454 | | 7/1995 |

OTHER PUBLICATIONS

PCT International Search Report for PCT/US2006/036259 mailed Jan. 25, 2007.

* cited by examiner

*Primary Examiner*—Chau N Nguyen
(74) *Attorney, Agent, or Firm*—Carter, DeLuca, Farrell & Schmidt, LLP

(57) ABSTRACT

An electrical cable bulk which can be coiled includes a jacket; a first wire assembly and a second wire assembly. The first wire assembly includes a shield conductor member at least partially shielding a first wire set. The first wire set includes a pair of insulated conductors disposed contiguously within the shield conductor member; and a ground conductor disposed within the shield conductor member. The second wire assembly includes a first shield conductor member at least partially shielding a second wire set. The second wire set includes a first pair of insulated conductors disposed contiguously within the first shield conductor member and a second pair of insulated conductors disposed contiguously within the first shield conductor member. The second wire assembly includes a second shield conductor member around a drain conductor and the first shield conductor member. The first and second wire assemblies are disposed within the jacket.

35 Claims, 3 Drawing Sheets

COILED ELECTRONIC ARTICLE SURVEILLANCE (EAS) CABLE

BACKGROUND

Coiled cables which are self-retracting create a cleaner, more organized work area. Creating a coiled electronic article surveillance (EAS) cable, particularly for a universal serial bus (USB) application, poses many challenges because of stringent electromagnetic shielding design criteria regarding electromagnetic emissions and interference immunity required by regulatory agencies around the world. In the prior art, coiled cables which meet the electrical shielding design criteria exhibit a reduced effective life or elasticity of the coil retraction.

SUMMARY

The present disclosure relates to an electrical cable bulk including a jacket, a first wire assembly and a second wire assembly. The first wire assembly includes a shield conductor member at least partially shielding a first wire set, and the first wire set includes a pair of insulated conductors disposed contiguously within the shield conductor member. The first wire set may include a drain conductor disposed within the shield conductor member at least partially shielding the first wire set.

The second wire assembly includes a first shield conductor member at least partially shielding a second wire set. The second wire set includes a first pair of insulated conductors disposed contiguously within the first shield conductor member, and a second pair of insulated conductors disposed contiguously within the first shield member. The second wire assembly may include a second shield conductor and a drain conductor which is disposed externally to the first shield conductor and the second shield conductor at least partially encloses the first shield conductor. The first wire assembly and the second wire assembly are disposed within the jacket. The disclosed assemblies, and their components, create a unique cable bulk that is able to meet stringent electromagnetic emissions and interference immunity requirements while being durable enough to survive high levels of mechanical abuse. The disclosed combination of materials, layered in certain forms, gives this cable bulk high levels of electromagnetic interference (EMI) shielding, typically found in rigid materials, in a form that is highly elastic, allowing for greater longevity of such a cable in physical use.

BRIEF DESCRIPTION OF THE DRAWINGS

The subject matter regarded as the embodiments is particularly pointed out and distinctly claimed in the concluding portion of the specification. The embodiments, however, both as to organization and method of operation, together with objects, features, and advantages thereof, may best be understood by reference to the following detailed description when read with the accompanying drawings in which:

DETAILED DESCRIPTION

The present disclosure will be understood more fully from the detailed description given below and from the accompanying drawings of particular embodiments of the invention which, however, should not be taken to limit the invention to a specific embodiment but are for explanatory purposes.

Numerous specific details may be set forth herein to provide a thorough understanding of a number of possible embodiments of a coiled electronic article surveillance (EAS) universal serial bus (USB) cable incorporating the present disclosure. It will be understood by those skilled in the art, however, that the embodiments may be practiced without these specific details. In other instances, well-known methods, procedures, components and circuits have not been described in detail so as not to obscure the embodiments. It can be appreciated that the specific structural and functional details disclosed herein may be representative and do not necessarily limit the scope of the embodiments.

Some embodiments may be described using the expression "coupled" and "connected" along with their derivatives. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments disclosed herein are not necessarily limited in this context.

It is worthy to note that any reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Figure 1A:
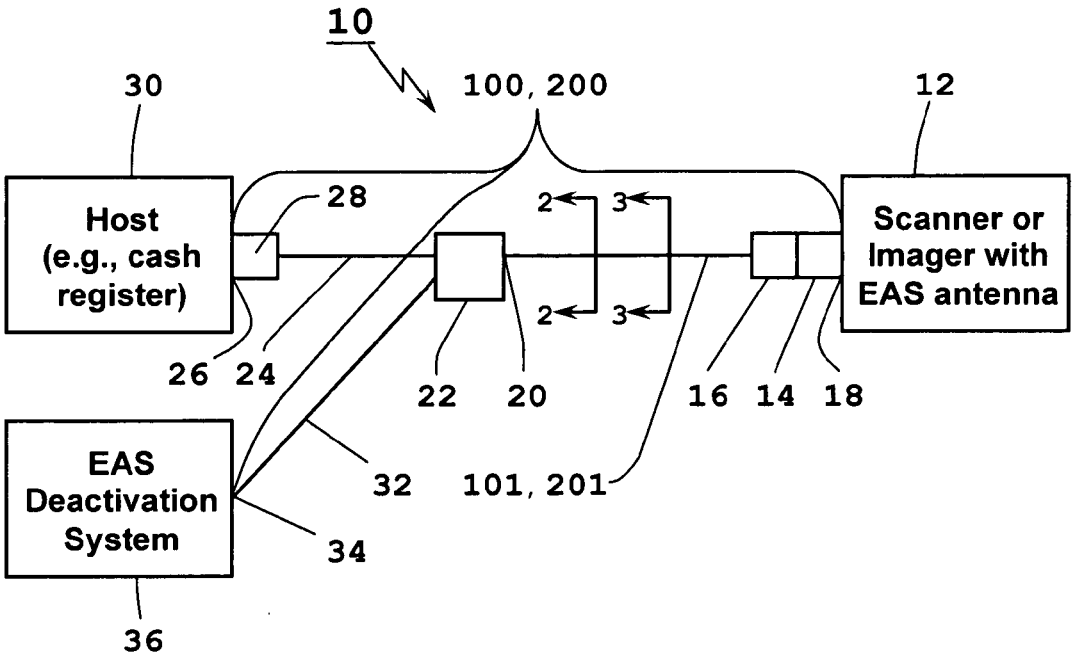
FIG. 1A is a schematic diagram of a coiled EAS cable coupled to an EAS system according to one embodiment of the present disclosure.

Turning now to the details of the present disclosure, FIG. 1A illustrates one embodiment of an EAS system 10 which includes a coiled EAS cable 100 according to one embodiment of the present disclosure or a coiled EAS cable 200 according to another embodiment of the present disclosure. The EAS system 10 includes a scanner or imager 12 at a distal end 18 of the cable 100 or cable 200 and a host 30. More particularly, the scanner or imager 12, which includes an EAS antenna (not shown) for transmitting and receiving EAS signals, is coupled to a cable bulk 101 of the coiled EAS cable 100 or to a cable bulk 201 of the coiled EAS cable 200 at the distal end 18 of the cable bulk 101 or cable bulk 201 via a connector 14.

In the drawings and in the descriptions which follow, the term "proximal" will refer to the end of the cable 100 or cable 200 which is closer to the host 30, while the term "distal" will refer to the end which is further from the host 30, since a user is typically positioned at the host 30, the host 30 typically including, but not limited to, a cash register or other article inventory device and having a USB connector 28.

Typically, in one embodiment, the connector 14 is coupled to or integrated with a strain relief or stress reinforcement member 16. The strain relief 16 enhances the mechanical durability of the connection formed by the connector 14 to the scanner or imager 12, and is applied since the user typically manipulates the scanner or imager 12 numerous times during the functional life of the EAS cable 100 or 200.

Figure 2:
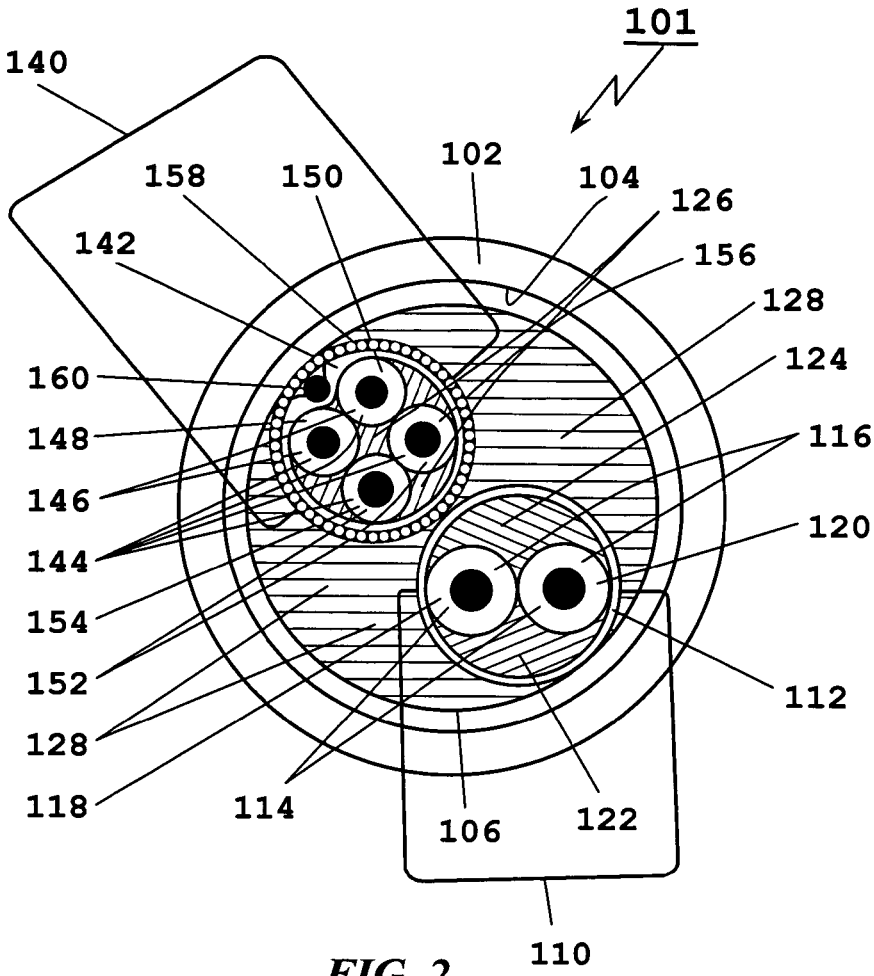
FIG. 2 is a cross-sectional view of a cable bulk forming the coiled EAS cable taken along cross-section line 2-2 of FIGS. 1A and 1B according to one embodiment of the present disclosure.
Figure 3:
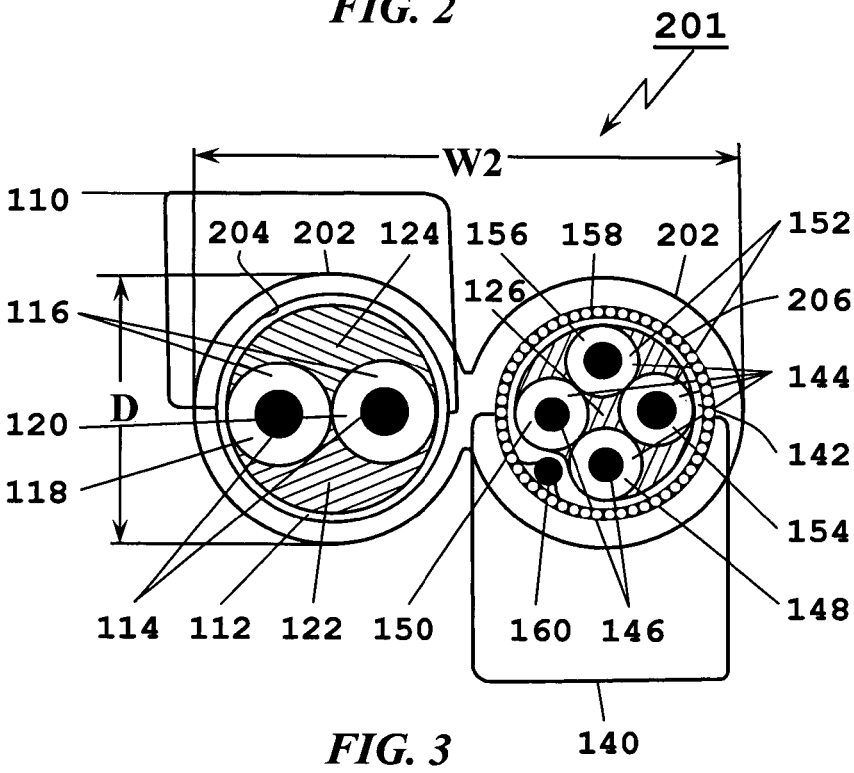
FIG. 3 is cross-sectional view of a cable bulk forming the coiled EAS cable taken along cross-section line 3-3 of FIGS. 1A and 1B according to one embodiment of the present disclosure.

As shown in FIG. 2, the cable bulk 101 includes a first wire assembly 110 and a second wire assembly 140 each housed within a typically substantially cylindrical jacket 102. Similarly, as shown in FIG. 3, the cable bulk 201 includes first wire assembly 110 and second wire assembly 140. The cable bulk 201 includes a jacket 202 having a typically figure-8 shaped cross-section, and as explained in more detail below, first wire assembly 110 and second wire assembly 140 are both housed within the jacket 202 but separated from each other.

Referring back to FIG. 1A, a proximal end 20 of the cable 100 and of the cable 200 is coupled to a Y-type junction 22 from which the second wire assembly 140, which typically carries host-related signals, emerges as a host cable bulk 24. The host cable bulk 24 relays the host-related signals, and is coupled at a proximal end 26 to the host 30 typically via a USB connector 28. Similarly, the first wire assembly 110, which typically carries EAS-related signals, through the cable 100 and through the cable 200, emerges from the Y-type junction 22 as an EAS deactivation system cable bulk 32 which relays the EAS-related signals. The cable bulk 32 is coupled at an end 34 to an EAS deactivation system 36 which transmits and receives the EAS-related signals to the scanner or imager 12 via the cable bulk 32 and the first wire assembly 110.

Therefore, the cable 100 or 200 includes typically the connector 14, the strain relief 16, cable bulk 101 or 201, respectively, the Y-type junction 22, the cable bulk 24 extending to the host connector 28 and cable bulk 32 extending from the Y-type junction 22 to the EAS deactivation system 36. The cable 100, 200 extends in a coiled form from the scanner or imager 12, providing convenience to the user.

Figure 1B:
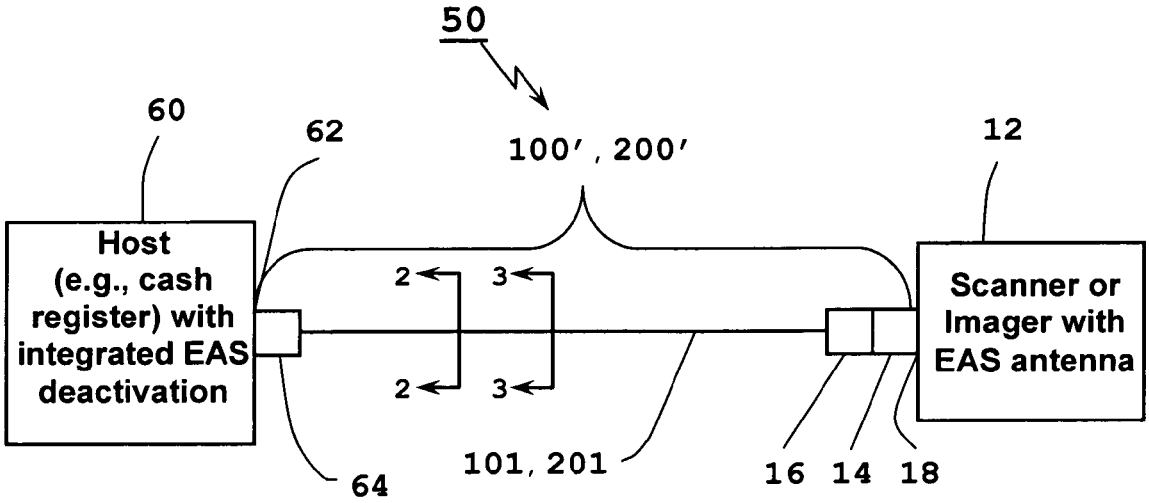
FIG. 1B is a schematic diagram of the coiled EAS cable of FIG. 1A coupled to an EAS system according to one embodiment of the present disclosure.

FIG. 1B illustrates one embodiment of an EAS system 50 which includes a coiled EAS cable 100' or a coiled EAS cable 200'. The EAS system 50 includes the scanner or imager 12 at the distal end 18 of the cable 100' or cable 200' and a host 60. More particularly, the scanner or imager 12, which as previously mentioned includes an EAS antenna (not shown) for transmitting and receiving EAS-related signals, is coupled to a cable bulk 101 of the coiled EAS cable 100' or to a cable bulk 201 of the coiled EAS cable 200' at the distal end 18 of the cable bulk 101 or cable bulk 201 via a connector 14. EAS system 50 differs from EAS system 10 in that the cable bulks 101 and 201 are coupled at their proximal end 62 directly to the host 60 via a connector 64, which typically is configured specifically to interface with the particular host 60, and is not typically a USB connector. The Y-type connector 22 is typically omitted. The host 60 is now an integrated device which typically includes, but is not limited to, a cash register or other article inventory portion and also includes circuitry in an EAS deactivation portion. Therefore, the second wire assembly 140 (see FIGS. 2-3) transfers host-related signals directly from the scanner or imager 12 to the host 60, while the first wire assembly 110 (see FIGS. 2-3) transfers EAS-related signals directly from the scanner or imager 12 to the host 60.

As a result, the cable 100' includes the connector 14 and the cable bulk 101, and extends in a coiled form from the scanner or imager 12 to the connector 62, providing convenience to the user. Similarly, the cable 200' includes the connector 14 and the cable bulk 201, and extends also in a coiled form from the scanner or imager 12 to the connector 64, again providing convenience to the user.

FIG. 2 shows a cross-sectional view of the cable bulk 101 forming the coiled EAS USB cables 100, 100' according to one embodiment of the present disclosure. More particularly, cable bulk 101 includes a substantially cylindrical jacket 102 which includes an interior surface 104. The jacket 102 includes the first wire assembly 110, with the first wire assembly 110 including a shield conductor member 112 at least partially shielding a first wire set 114. The shield conductor member 112 is typically substantially cylindrical in form.

The first wire set 114 includes a pair 116 of insulated conductors 118, 120 disposed contiguously within the shield conductor member 112 which at least partially shields the first wire set 114, and a drain line or conductor 122 also disposed within the shield conductor member 112 at least partially shielding the first wire set 114. The pair 116 of insulated conductors 118, 120 are typically antenna conductors. The remaining interior space within the shield conductor member 112 is substantially occupied with a filler 124 so as to effect a substantially round cross-section for member 112.

The cable bulk 101 also includes a second wire assembly 140, with the second wire assembly 140 including a first shield conductor member 142 at least partially shielding a second wire set 144. Typically, the first shield conductor member 142 is substantially cylindrical. The second wire set 144 includes a first pair 146 of insulated conductors 148, 150 disposed contiguously within the shield conductor member 142 at least partially shielding the second wire set 144. The first pair 146 of insulated conductors 148, 150 can be a twisted signal pair of conductors.

The second wire set 144 also includes a second pair 152 of insulated conductors 154, 156 disposed contiguously within the first shield conductor member 142. The remaining interior space within the member 142 is substantially occupied with a filler 126 so as to effect a substantially round cross-section for cylindrical member 142.

In the embodiment illustrated in FIG. 2, the first wire assembly 110 and the second wire assembly 140 are disposed within the jacket 102. The jacket 102 may include a jacket liner 106 disposed on the interior surface 104. Therefore, the jacket 102 is configured such that the interior surface 104 at least partially jackets the first and second wire assemblies 110 and 140, respectively. Similarly, the liner 106 is disposed within the jacket so as to at least partially contact the first and second wire assemblies 110 and 140, respectively. The remaining interior space within the substantially cylindrical jacket 102 is occupied with a filler 128 so as to effect a substantially round cross-section for jacket 102.

In one embodiment, the second wire assembly 140 includes a second shield conductor member 158 and a drain line or conductor 160. The drain conductor 160 is disposed externally to the first shield conductor member 142 at least partially shielding the second wire set 140, and the second shield conductor member 158 at least partially encloses the drain conductor 160 and the first shield conductor member 142. The second shield conductor member 158 is typically in the form of a braid and is typically substantially cylindrical. The embodiments are not limited in this context.

FIG. 3 illustrates one embodiment of the cross section of the cable bulk 201 forming the coiled EAS cable 200, 200' in accordance with the present disclosure. More particularly, cable bulk 201 includes a jacket 202 having a figure-8 shaped cross-section. The jacket 202 has a first interior surface 204 and a second interior surface 206. The jacket 202 is configured such that the first interior surface 204 at least partially jackets the first wire assembly 110 and the second interior surface 206 at least partially jackets the second wire assembly 140. The second wire assembly 140 typically includes the second shield conductor member 158.

Referring to both FIGS. 2 and 3, the jackets 102 and 202 include, but are not limited to, polymer materials such as thermo plastic elastomers (TPE), or polyvinyl chloride (PVC) As seen in FIG. 2, the jacket 102 has an outer diameter W1 of about 7 mm and more particularly having outer diameter W1 ranging from about 6.85 mm to about 7.15 mm. The jacket liner 106 includes, but is not limited to, cotton paper. The filler material 128 is made typically from, but is not limited to, cotton yarn.

Figure 2A:
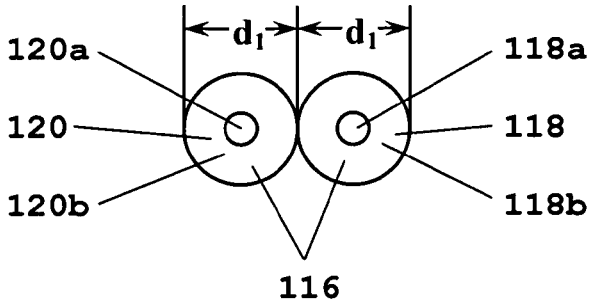
FIG. 2A is a detailed view of a pair of insulated conductors according to the present disclosure.

Referring also to FIG. 2A, the pair 116 of insulated wire conductors 118, 120 of first wire assembly 110 includes typically, but is not limited to, tinned copper wire 118*a*, 120*a* of 22AWG (105 strand/0.05 mm diameter wire plus No. 1 tinsel wire). The insulation 118*b*, 120*b* includes typically, but is not limited to, TPE materials such as polypropylene, and having an outer diameter d1 of about 1.3 mm and more particularly, the diameter d1 ranges from about 1.25 mm to about 1.35 mm.

The filler material 124 includes typically, but is not limited to, a synthetic polymer such as nylon. The shield conductor member 112 includes typically, but is not limited to, an aluminum-polyester sheet or substrate, the polyester typically being made from, but is not limited to, Mylar®. In one embodiment, an aluminum—Mylar® sheet may be made from a thin Aluminum sheet and a thin Mylar® sheet. The two are bonded together to make the Aluminum-Mylar® sheet or substrate. The shield conductor member 112 may include an aluminum wrap exterior with approximately a 25% overlap over each layer. The drain conductor 122 includes typically, but is not limited to, 24# (45 strand/0.08 mm diameter plus No. 1 Tinsel wire) tinned copper wire. The embodiments are not limited in this context.

Figure 2B:
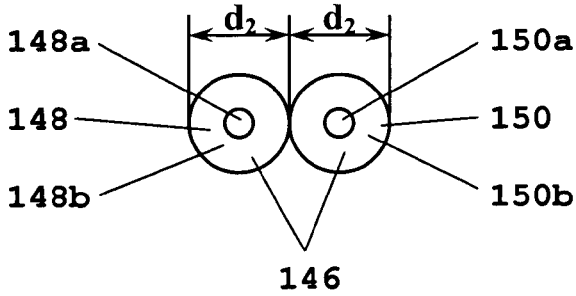
FIG. 2B is a detailed view of another pair of insulated conductors according to the present disclosure.

Referring also to FIG. 2B, the first pair 146 of insulated conductors 148, 150 of second wire assembly 140 includes typically, but is not limited to, tinned copper wire 148*a*, 150*a* of 28AWG (40 strand/0.05 mm diameter wire plus No. 1 tinsel wire). The insulation 148*b*, 150*b* includes typically, but is not limited to, a TPE material such as polypropylene having an outer diameter d2 of about 0.95 mm and more particularly, the diameter d2 ranges from about 0.90 mm to about 1.00 mm.

Figure 2C:
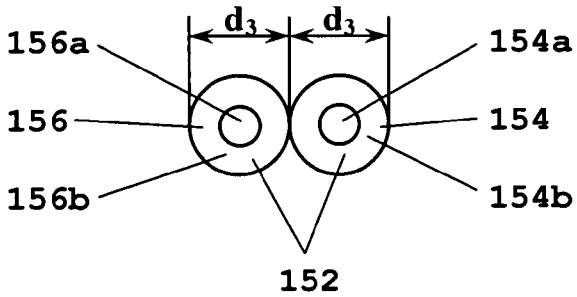
FIG. 2C is a detailed view of still another pair of insulated conductors according to the present disclosure.

Referring also to FIG. 2C, the second pair 152 of insulated conductors 154, 156 of second wire assembly 140 includes typically, but is not limited to, tinned copper wire 154*a*, 156*a* of 24AWG (45 strand/0.08 mm diameter wire plus No. 1 tinsel wire). The insulation 154*b*, 156*b* includes typically, but is not limited to, TPE material such as polypropylene and having an outer diameter d3 of about 1.00 mm and more particularly, the diameter d3 ranges from about 0.95 mm to about 1.05 mm.

The filler material 126 includes typically, but is not limited to, polypropylene cord. The first shield conductor member 142 includes typically, but is not limited to, an aluminum-polyester sheet as described above with respect to shield conductor member 112. The shield conductor member 142 may include an aluminum wrap exterior with approximately a 25% overlap over each layer. The ground conductor 160 includes typically, but is not limited to, 24# (40 strand/0.05 mm diameter) tinned copper wire.

The second shield conductor member 158 includes typically, but is not limited to a braid in a weave pattern using the copper wire. The weave pattern includes typically about 16 bundles interweaved and each bundle includes typically about eight wires and the diameter of each wire is about 0.08 mm. The weave pattern at least partially or entirely covers an outer surface of the second wire assembly 140, resulting in typically a minimum of 90% coverage of all wires inside the second wire assembly 140.

As seen in FIG. 3, the cable bulk 201 has an outer diametrical dimension D of the figure-8 cross-section of about 4.2 mm and more particularly the dimension D ranges from about 4.05 mm to about 4.35 mm. The cable bulk 201 has an end-to-end dimension "W2" of the figure-8 cross-section of about 8.4 mm and more particularly the dimension W2 ranges from about 8.1 mm to about 8.7 mm. The cable bulk 201 may be coiled around an axis X-X which extends from end-to-end of the figure-8 cross-section. The coiling of the cable bulk 201 is similar to the manner of coiling a flat telephone cord.

Figure 4:
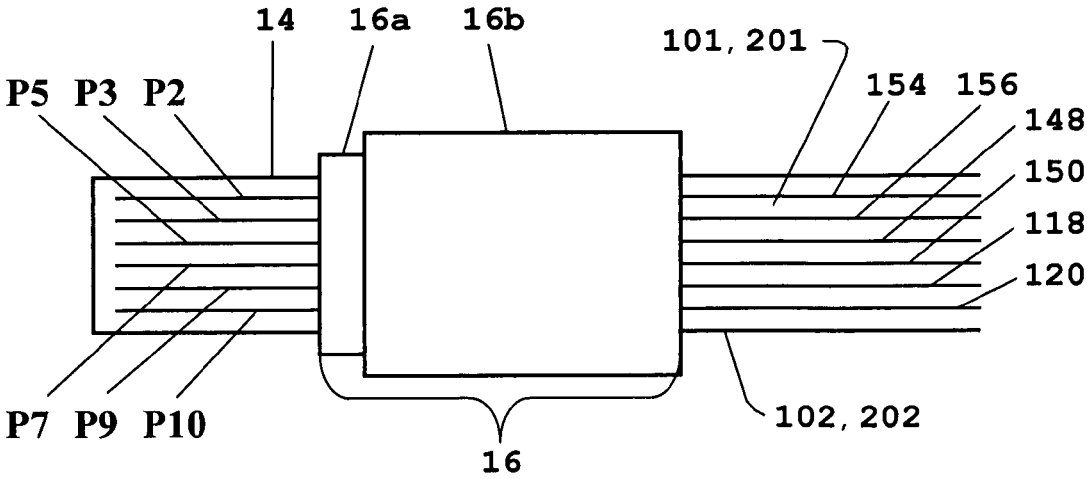
FIG. 4 is a schematic diagram of the coiled EAS cable coupled to a terminal end connector according to one embodiment of the present disclosure.

Referring to FIG. 4, the cable bulks 101, 201 are connected to the connector 14, which is typically a modular plug type such as an RJ46 type. More particularly, the wires or conductors 118, 120,148, 150, 154 and 156 originating from the EAS/USB cable bulks 101, 201 are terminated in the plug connector 14, although there may be other wires or conductors serving other functions which are terminated in the plug connector 14. The embodiments are not limited in this context. The routing of the wires or conductors 118, 120, 148, 150, 154 and 156 inside the plug connector 14 conforms to, typically, but is not limited to, a specified pattern such as described below in TABLE 1

TABLE 1

| CONNECTOR PIN | CONDUCTOR |
|---|---|
| P2 | Scanner or Imager 12 Power Supply - Conductor 154 |
| P3 | Scanner or Imager 12 Signal Ground, Drain - Conductor 156 |
| P5 | Host 30 or 60 Positive, e.g., USB "D+" as specified by the USB Committee - Conductor 148 |
| P7 | Host 30 or 60 Negative, e.g., USB "D−" as specified by the USB Committee - Conductor 150 |
| P9 | EAS - Out Signal - Conductor 118 |
| P10 | EAS - In Signal - Conductor line 120 |

In one embodiment, ground conductor 160 may be electrically connected to drain conductor 156 prior to drain conductor 156 being terminated as pin P 3 in plug connector 14. Secondary shield conductor member 158 is typically electrically connected to drain conductor 156 and is not terminated at the plug connector 14.

The EAS/USB cable bulk jacket 102, 202 is typically secured to the connector 14 using two separate molding processes using typically two different TPE material types, such as previously described above. The first molding process injects a small amount of TPE material around the plug connector 14 as a pre-mold 16*a* of strain relief 16. The second molding process injects a larger amount of TPE material as a second mold material 16*b* forming a larger portion of the strain relief 16 around the plug connector 14, the pre mold 16*a* and the cable bulk jacket 102, 202 . The result of the molding processes is a cable assembly with high durability. The EAS/USB cable bulk 101, 102 with the strain relief 16 is tested by completing accelerated life testing.

As a result of the foregoing disclosure, cables 100 and 200 provide a coiled cable for EAS which are suitable for application as USB cables which meet the stringent electromagnetic shielding requirements for electromagnetic emissions and interference immunity required by regulatory agencies around the world, while at the same time providing an extended coil life and elasticity of the coil retraction. The physical arrangement of the first and second wire assemblies 110 and 140, respectively, within the jackets 102 and 202 in combination with the specified materials and sizes provides the necessary shielding and extended coil life and elasticity. Specifically, the first wire assembly 110 carries the antenna signal currents which must be shielded from the power and USB signal currents carried by the second wire assembly 140. More particularly, the disclosed combination of materials, layered in the disclosed arrangement, yields the extended levels of electromagnetic shielding, typically only available from rigid materials, in a form that is elastic and able to be coiled.

While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of exemplary embodiments. Those skilled in the art will envision other modifications within the scope and spirit of the claims appended hereto.

What is claimed is:

1. An electrical cable bulk comprising:

a jacket having a figure-8 cross-section;

a first wire assembly and a second wire assembly disposed within the jacket wherein the diameter of the first wire assembly is substantially equal to the diameter of the second wire assembly;

the first wire assembly including:

a shield conductor member at least partially shielding a first wire set, the first wire set including:

a pair of insulated conductors disposed contiguously within the shield conductor member; and the second wire assembly including:

a first shield conductor member at least partially shielding a second wire set, the second wire set including:

a first pair of insulated conductors disposed contiguously within the first shield conductor member; and a second pair of insulated conductors disposed contiguously within the first shield conductor member;

where the number of insulated conductors in the second wire assembly is twice the number of insulated conductors in the first wire assembly.

2. The electrical cable bulk according to claim 1, wherein the first wire set further comprises a drain conductor disposed within the shield conductor member.

3. The electrical cable bulk according to claim 1, wherein the jacket has an interior surface, and the jacket is configured such that the interior surface of the jacket at least partially jackets the first and second wire assemblies.

4. The electrical cable bulk according to claim 1, wherein the jacket has a first interior surface and a second interior surface, and the jacket is configured such the first interior surface at least partially jackets the first wire assembly and the second interior surface at least partially jackets the second wire assembly.

5. The electrical cable bulk according to claim 1, wherein the second wire assembly further comprises:

a second shield conductor member; and a drain conductor, wherein the drain conductor is disposed externally to the first shield conductor member, and the second shield conductor member at least partially encloses the drain conductor and the first shield conductor member.

6. The electrical cable bulk according to claim 5, wherein the jacket has an interior surface, and the jacket is configured such that the interior surface of the jacket at least partially jackets the first and second wire assemblies.

7. The electrical cable bulk according to claim 6, wherein the interior surface of the jacket further comprises a liner disposed within the jacket so as to at least partially contact the first and second wire assemblies.

8. The electrical cable bulk according to claim 5, wherein the jacket has a first interior surface and a second interior surface, and the jacket is configured such that the first interior surface at least partially jackets the first wire assembly and the second interior surface at least partially jackets the second wire assembly.

9. The electrical cable bulk according to claim 8, wherein the jacket further comprises a liner disposed between the first interior surface and the first wire assembly so as to at least partially contact the first wire assembly.

10. The electrical cable bulk according to claim 5, wherein the second shield conductor member comprises a braid of tinned copper wire.

11. The electrical cable bulk according to claim 10, wherein the braid is in a weaved pattern including about 16 bundles interweaved and each bundle includes about eight wires and the diameter of each wire is about 0.08 mm.

12. The electrical cable bulk according to claim 5, wherein the cable is for a universal serial bus (USB).

13. The electrical cable bulk according to claim 1, wherein the cable is for a universal serial bus (USB).

14. The electrical cable bulk according to claim 1, wherein the jacket has an outer diameter ranging from about 6.85 mm to about 7.15 mm.

15. The electrical cable bulk according to claim 1, wherein the jacket has an outer diametrical dimension ranging from about 4.05 mm to about 4.35 mm.

16. The electrical cable bulk according to claim 1, wherein the jacket has a height dimension ranging from about 8.1 mm to about 8.7 mm.

17. The electrical cable bulk according to claim 1, wherein the pair of insulated conductors of the first wire assembly comprises tinned copper wire of 22AWG.

18. The electrical cable bulk according to claim 1, wherein an outer diameter of the insulation of the insulated conductors ranges from about 1.25 mm to about 1.35 mm.

19. The electrical cable bulk according to claim 1, wherein the shield conductor member at least partially shielding the first wire set comprises an aluminum-polyester substrate.

20. The electrical cable bulk according to claim 1, wherein a drain conductor disposed within the shield conductor member at least partially shielding the first wire set and comprises tinned copper wire.

21. The electrical cable bulk according to claim 1, wherein the first shield conductor member comprises an aluminum-polyester substrate.

22. The electrical cable bulk according to claim 1, wherein the first pair of insulated conductors comprises tinned copper wire of 28 AWG.

23. The electrical cable bulk according to claim 1, wherein the second pair of insulated conductors comprises tinned copper wire of 24 AWG.

24. An electrical cable bulk comprising:

a jacket having a figure-8 cross-section;

a first wire assembly and a second wire assembly disposed within the jacket wherein the diameter of the first wire assembly is substantially equal to the diameter of the second wire assembly;

the first wire assembly including:

a shield conductor member at least partially shielding a first wire set, the first wire set including:

at least two insulated conductors disposed contiguously within the shield conductor member; and the second wire assembly including:

a second wire set, the second wire set including:

a first shield conductor member at least partially shielding the second wire set;

a first pair of insulated conductors disposed contiguously within the first shield conductor member; and a second pair of insulated conductors disposed contiguously within the first shield conductor member, wherein the jacket has an interior surface, and the jacket is configured such that the interior surface of the jacket at least partially jackets the first and second wire assemblies; and wherein the number of insulated conductors in the second wire assembly is twice the number of insulated conductors in the first wire assembly.

25. The electrical cable bulk according to claim 24, wherein the first wire set further comprises a drain conductor disposed within the shield conductor member.

26. The electrical cable bulk according to claim 24, wherein the second wire assembly further comprises:

a second shield conductor member; and a drain conductor, wherein the drain conductor is disposed externally to the first shield conductor member, and the second shield conductor member at least partially encloses the drain conductor and the first shield conductor member.

27. The electrical cable bulk according to claim 24, wherein the interior surface of the jacket further comprises a liner disposed within the jacket so as to at least partially contact the first and second wire assemblies.

28. The electrical cable bulk according to claim 24, wherein the cable bulk is for a universal serial bus (USB).

29. An electrical cable bulk comprising:

a jacket having a figure-8 cross-section;

a first wire assembly and a second wire assembly disposed within the jacket wherein the diameter of the first wire assembly is substantially equal to the diameter of the second wire assembly;

the first wire assembly including:

a shield conductor member at least partially shielding a first wire set, the first wire set including:

at least two insulated conductors disposed contiguously within the shield conductor member; and the second wire assembly including:

a first shield conductor member at least partially shielding a second wire set, the second wire set including:

a first pair of insulated conductors disposed contiguously within the first shield conductor member; and a second pair of insulated conductors disposed contiguously within the first shield conductor member, wherein the jacket has a first interior surface and a second interior surface, and the jacket is configured such that the first interior surface at least partially jackets the first wire assembly and the second interior surface at least partially jackets the second wire assembly; and wherein the number of insulated conductors in the second wire assembly is twice the number of insulated conductors in the first wire assembly.

30. The electrical cable bulk according to claim 29, wherein the first wire set further comprises a drain conductor disposed within the shield conductor member.

31. The electrical cable bulk according to claim 29, wherein the second wire assembly further comprises:

a second shield conductor member; and a drain conductor, wherein the drain conductor is disposed externally to the first shield conductor member, and the second shield conductor member at least partially encloses the drain conductor and the first shield conductor member.

32. The electrical cable bulk according to claim 29, wherein the cable is for a universal serial bus (USB).

33. An electrical cable bulk comprising:

a physical arrangement comprising:

a jacket having a figure-8 cross-section and comprising of at least one polymer material;

a first wire assembly, the first wire assembly including:

a shield conductor member comprising of a polyester material and at least partially shielding a first wire set, the first wire set including:

a pair of insulated conductors disposed contiguously within the shield conductor member; and a second wire assembly, the second wire assembly including:

a first shield conductor member comprising of a polyester material and at least partially shielding a second wire set, the second wire set including:

a first pair of insulated conductors disposed contiguously within the first shield conductor member; and a second pair of insulated conductors disposed contiguously within the first shield conductor member;

wherein said physical arrangement in combination with at least synthetic polymer filler material disposed within the jacket and said shield conductor member and said first shield conductor member provide said cable with a highly elastic characteristic; and wherein the number of insulated conductors in the second wire assembly is twice the number of insulated conductors in the first wire assembly.

34. The electrical cable bulk according to claim 33, wherein the diameter of the first wire assembly is substantially equal to the diameter of the second wire assembly.

35. The electrical cable bulk according to claim 33, wherein the second wire assembly includes a second shield conductor member and a drain conductor disposed externally to the first shield conductor member at least partially shielding the second wire set and at least partially enclosing the drain conductor and the first shield conductor member.

* * * * *